US008638644B2

(12) United States Patent
Favre et al.

(10) Patent No.: US 8,638,644 B2
(45) Date of Patent: Jan. 28, 2014

(54) ACOUSTIC RADIATING MEMBRANE FOR A MUSIC BOX OR STRIKING WATCH

(75) Inventors: Jèrôme Favre, Les Bioux (CH); Nakis Karapatis, Premier (CH)

(73) Assignee: Montres Breguet SA, L'Abbaye (CH)

( * ) Notice: Subject to any disclaimer, the term of this patent is extended or adjusted under 35 U.S.C. 154(b) by 17 days.

(21) Appl. No.: 13/283,149

(22) Filed: Oct. 27, 2011

(65) Prior Publication Data

US 2012/0140602 A1 Jun. 7, 2012

(30) Foreign Application Priority Data

Dec. 2, 2010 (EP) ..... 10193427

(51) Int. Cl.
*G04B 21/00* (2006.01)

(52) U.S. Cl.
USPC ..... 368/272

(58) Field of Classification Search
USPC ..... 368/272, 243–245, 315, 72; 367/138, 367/158; 84/422.3, 422.4
See application file for complete search history.

(56) References Cited

U.S. PATENT DOCUMENTS 2,786,326 A * 3/1957 Junghans et al. ..... 368/244
3,732,686 A * 5/1973 Zaugg ..... 368/37
4,258,432 A * 3/1981 Zafferri et al. ..... 368/250
5,299,175 A * 3/1994 Gallego-Juarez et al. .... 367/138
2007/0163424 A1* 7/2007 Mintz ..... 84/422.3
2009/0257317 A1* 10/2009 Gallego Juarez et al. .... 367/157

FOREIGN PATENT DOCUMENTS

CH 581 860 B5 11/1976
DE 604 400 C 9/1933
GB 1 022 881 A 3/1966

OTHER PUBLICATIONS

European Search Report of EP 10 19 3427 dated May 27, 2011.

* cited by examiner

*Primary Examiner* — Edwin A. Leon
(74) *Attorney, Agent, or Firm* — Sughrue Mion, PLLC

(57) ABSTRACT

The acoustic radiating membrane (1) is for assembly in a music box or a striking watch. The membrane includes a first sheet (2) having a certain number of cells (5), which is secured to a first face of a second sheet (3) which has no cells. The membrane may also include a third sheet (4) having a certain number of cells (6) which is fixed to a second face of the second sheet (3). The shape and dimension of the cells are adapted according to the type of material and the note or notes to be radiated by the membrane with uniform amplification within the audible frequency band. The cells (5, 6) of the first and third sheets are configured in a honeycomb arrangement to occupy most of the surface of the membrane, for the uniform amplification and efficient radiation of the note or notes produced.

15 Claims, 2 Drawing Sheets

ACOUSTIC RADIATING MEMBRANE FOR A MUSIC BOX OR STRIKING WATCH

Figure 1:
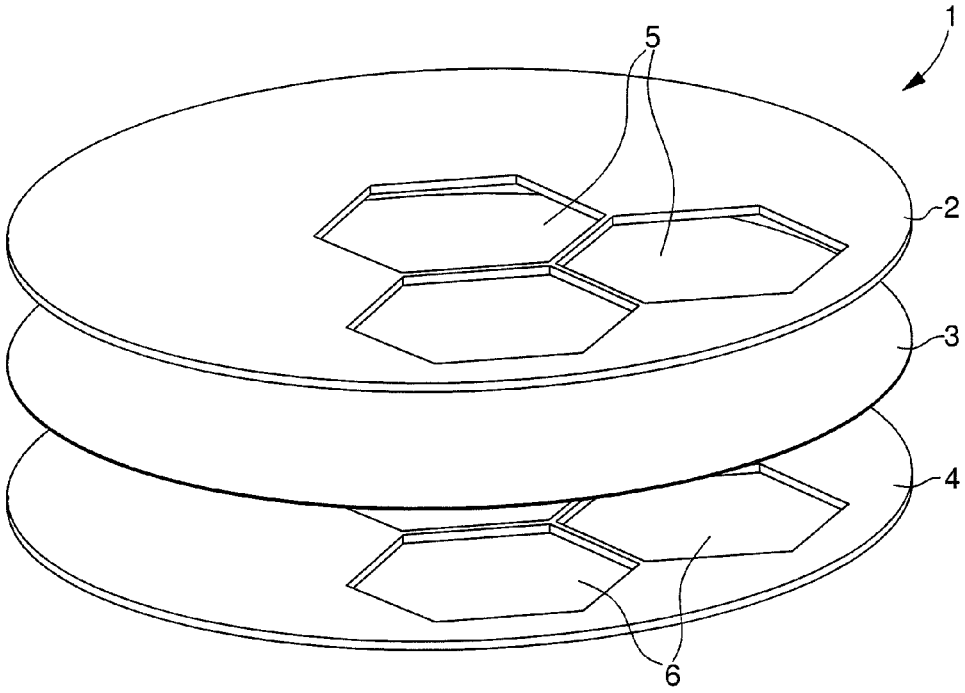

This application claims priority from European Patent Application No. 10193427.1 filed 2 Dec. 2010, the entire disclosure of which is incorporated herein by reference.

FIELD OF THE INVENTION

The invention concerns an acoustic radiating membrane for a music box, such as a musical watch or a striking watch.

The invention also concerns a watch which includes an acoustic radiating membrane. The watch includes a watch case, essentially formed of a middle part and a back cover removably secured in a sealed manner to the middle part. A crystal is arranged on the opposite side to the back cover to close said case in a sealed manner. A timepiece movement is held inside the watch case and provided with a striking mechanism that can be actuated at determined times to produce a sound or music. At least one acoustic radiating membrane is connected to the case to radiate the sound produced by the striking mechanism towards the exterior of the case.

BACKGROUND OF THE INVENTION

In the field of horology, a timepiece movement of conventional architecture may also include a striking mechanism. This striking mechanism may be provided for generating at least one sound, via a gong, which is struck by a hammer at determined times in a striking watch to indicate a programmed alarm or minute repeaters. The gong is generally a metal wire of circular shape, which surrounds part of the watch movement inside a watch frame. The gong is fixed to a gong-carrier, which is integral with a bottom plate or with the watch case.

The striking mechanism may also be provided for generating music via a pin-barrel with several tongues, individually actuated by the pins of a cylinder or disc in a musical watch. The tongues of the pin-barrel are connected to the same heel, which may be fixed to the bottom plate or to the watch case, and the pins of the rotating cylinder or disc allow the free end of some tongues to be lifted. After the tongues have been bent via the action of the pins, the tongues are then released by the pins. The actuated tongues start to oscillate essentially at their first natural frequency.

The gong of the striking watch or the pin-barrel of the musical watch is arranged inside the watch case. Thus, the vibrations of the gong or the pin-barrel tongues are transmitted to the external parts of the watch. These external parts are, for example, the middle part, the bezel, the crystal and the back cover of the watch case. These large parts start to radiate sound into the air under the effect of the transmitted vibrations. When a sound is produced either by a gong struck by a hammer or by one or more vibrating pin-barrel tongues, these external parts are capable of radiating the produced sound into the air.

In a conventional striking or musical watch, acoustic efficiency, based on the complex vibro-acoustic transduction of the external parts, is low. In order to improve and increase the acoustic level perceived by the user of the striking or musical watch, the material, geometry and boundary conditions of the external parts must be taken into account. The configurations of these external parts are also dependent upon the aesthetic appearance of the watch and operating stresses, which may limit adaptation possibilities.

It is known in watchmaking technology to use an acoustic type membrane, which is dedicated to vibro-acoustic transduction, in a watch and particularly an electronic watch. To activate this type of membrane in an electronic watch, a piezoelectric element is, for example, placed on the membrane to cause it to vibrate, as mentioned in CH Patent No. 581 860. To prevent the acoustic radiation from the membrane from being lost in the watch, which must be sealed, a double back cover can be provided for the watch case, which must be open towards the exterior. In such case, the back cover of the watch case has one or more apertures for the transmission of sound from the vibrating membrane.

With this type of design for an electronic watch with an acoustic membrane, problems often arise relating to the sealing and corrosion of said membrane. The first natural vibration frequency of this membrane, which is the efficient radiation mode, must, in principle, be within the useful acoustic frequency band. However, the second natural frequency, which is an inefficient mode, must, if possible, be outside this audible band. The useful acoustic frequency band is generally between 1 kHz and 4 kHz. According to the boundary conditions and geometry set for the membrane, the physical properties, such as density and the Young's modulus, must allow the first and second natural frequencies to be adapted. If the membrane is made of steel, the first and second natural vibration frequencies do not fulfil the aforementioned conditions in an optimum manner. Moreover, rapid damping is observed, which is a drawback.

Generally, with the use of a conventional acoustic radiating membrane, a problem of frequency bandwidth exists. If the acoustic membrane has to be fitted to a music box, the frequencies to be radiated efficiently must typically range between 1 kHz and 4 kHz. In the case of a striking watch with minute repeaters, an alarm or even a quartz alarm, excellent results may be obtained by amplifying a single dominant frequency, tuned with the exciter.

In a standard striking watch, which is, for example, fitted with an acoustic membrane, the membrane is sandwiched between part of the middle case and the back cover of the watch. In the case of a luxury watch, the back cover may be made of a precious material, such as gold. A difference in electrochemical potential may occur on contact between the membrane, which is generally made of steel, and the gold back cover, especially in a humid environment. This is liable to contribute to the corrosion of said membrane where it is in contact with the gold back cover, which is another drawback. A corrosion resistant material must therefore be found which has no difference in potential with gold and low internal damping.

SUMMARY OF THE INVENTION

It is therefore an object of the invention to overcome the drawbacks of the aforementioned state of the art, by providing an acoustic radiating membrane for a music box or striking watch, made so as to provide the most uniform possible amplification across the audible frequency band, essentially within the frequency range of 1 kHz to 4 kHz.

The invention therefore concerns an acoustic radiating membrane, which includes an acoustic radiating membrane for a music box or striking watch, wherein the membrane includes, over a first thickness of the total thickness of the membrane, a certain number of cells or a certain number of projecting portions, wherein the shape and dimension of each cell or of each portion are adapted according to the type of material and the note to be radiated by the membrane.

Particular embodiments of the acoustic membrane are defined in the dependent claims 2 to 12.

One advantage of the acoustic radiating membrane according to the present invention lies in the fact that it includes projecting portions or, over at least a first thickness, smaller than the total thickness of the membrane, a certain number of cells. The dimension and shape of these cells or projecting portions depend upon the type of material of the membrane and the musical note or notes requiring efficient radiation.

Advantageously, the acoustic radiating membrane is formed of at least two sheets, wherein one of the sheets having the first thickness, is provided with a certain number of cells, preferably distributed in a honeycomb arrangement. The shape and dimension of each cell may depend upon the musical note to be efficiently radiated. Thus, the first sheet may include a number of cells of different dimensions for efficiently radiating an equivalent number of musical notes. This also increases the overall acoustic level, which may be perceived by a user of the music box or the striking watch in which said acoustic membrane is placed.

Advantageously, the acoustic radiating membrane includes a first sheet, with cells uniformly distributed in a honeycomb arrangement, which is fixed to a second sheet without any cells, and a third sheet with cells in a honeycomb, fixed to the opposite side of the second sheet. The second sheet may be a gold sheet, whereas the first and third sheets may be made of amorphous metal or metallic glass, or also gold. The arrangement of several sheets with cells may also increase the number of natural frequencies in the useful audible frequency band, i.e. between 1 kHz and 4 kHz, also in order to increase the overall acoustic level. With a membrane of this type, very low damping is observed, which provides very good acoustic efficiency.

The invention therefore concerns a watch, provided with an acoustic radiating membrane including the striking or musical watch, including a watch case, which has a middle part and a back cover having at least one lateral aperture, wherein the back cover is secured in a sealed and removable manner to the middle part, a crystal closing the case in a sealed manner, a watch movement held inside the watch case and provided with a striking mechanism capable of being actuated at determined times to produce one note or several notes, and at least one acoustic radiating membrane, which is arranged in the watch case.

Specific embodiments of the watch are defined in the dependent claims 14 to 16.

BRIEF DESCRIPTION OF THE INVENTION

Figure 2:
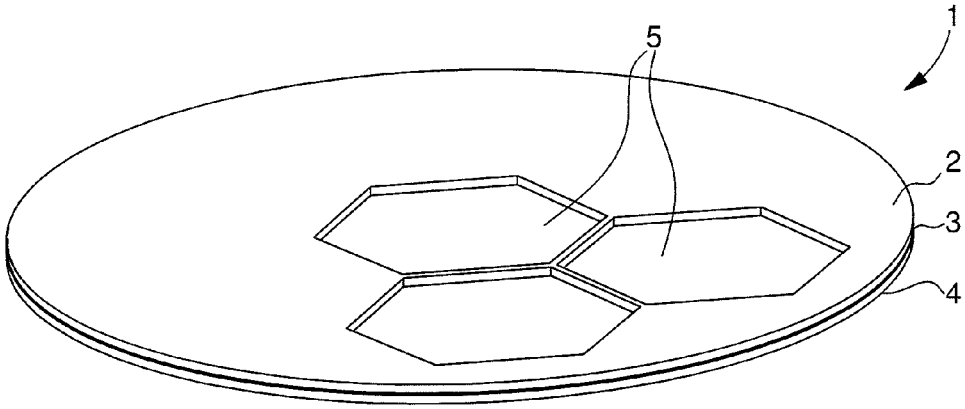
Figure 3:
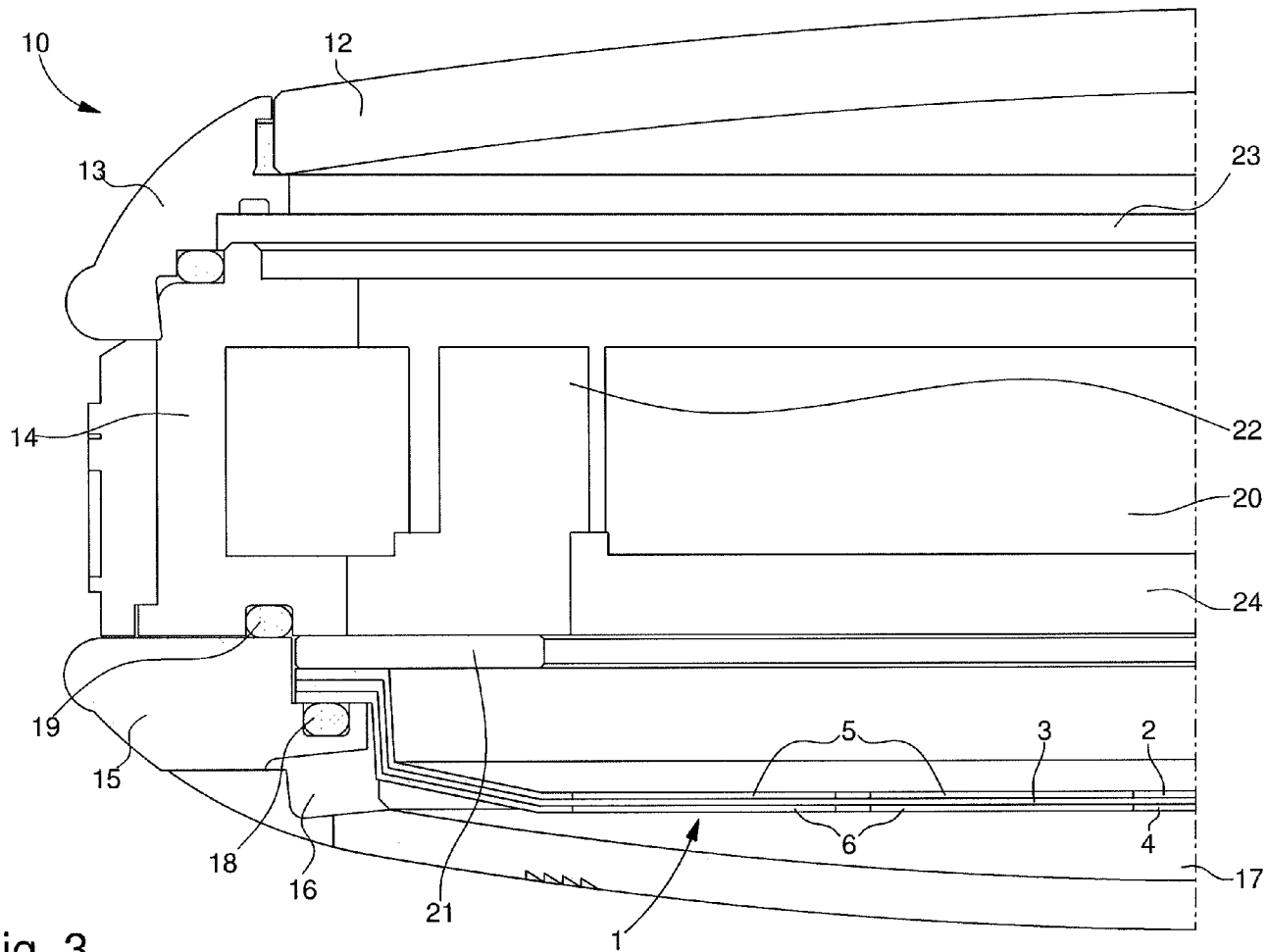

The objects, advantages and features of the acoustic radiating membrane for a music box or striking watch will appear more clearly in the following description given on the basis of at least one non-limiting embodiment, illustrated by the drawings, in which:

FIG. 1 shows a simplified, exploded, three-dimensional view of the various sheets forming the acoustic membrane according to the invention, FIG. 2 shows a simplified, three-dimensional view of the various assembled sheets, which form the acoustic radiating membrane according to the invention, and FIG. 3 shows a simplified, partial cross-section of a striking or musical watch, which is provided with an acoustic membrane according to the invention.

DETAILED DESCRIPTION OF THE INVENTION

In the following description, all those parts of a music box, such as a musical watch or a striking watch, which are well known to those skilled in the art in this technical field, will be described only in a simplified manner.

FIG. 1 shows a simplified, three-dimensional, exploded view of an acoustic radiating membrane 1 for a music box, such as a musical watch, or striking watch. In this embodiment, membrane 1 includes, first of all, a first sheet 2, which includes several cells 5, which may have identical or different dimensions. This first sheet 2 may be bonded or soldered to a first face of a second sheet 3, which has no cells, so as to ensure a certain level of sealing inside the watch, once the membrane is mounted in the watch case. A third sheet 4 with cells 6 of identical or different dimensions, may also be bonded or soldered onto a second face of second sheet 3. The cells 5 of the first sheet 2 may be arranged opposite the cells 6 of identical or different dimensions of the third sheet 4. However, it possible to envisage membrane 1 having only the first sheet 2 with a first thickness and second sheet 3 with a second thickness. The thickness of each sheet may be less than 0.2 mm and preferably close to 0.1 mm.

Cells 5, 6 of first sheet 2 and third sheet 4 are regularly spaced apart from each other, and configured in a honeycomb arrangement with six identical sides. Although only three cells are shown in FIG. 1, it is clear that said membrane 1 may include a larger number of cells to occupy most of the surface of acoustic membrane 1. Other cell shapes may also be envisaged, for example, circular or oval, but the honeycomb arrangement best enables the surface of the membrane to be filled with cells.

For radiating a particular note with uniform amplification in the audible frequency band, the cells of first sheet 2 are all of identical shape and dimensions. The dimension is also determined according to the material of first sheet 2 and of second sheet 3. The larger the size of the cell, the more bass the corresponding frequency will be, i.e. low frequency. For the same sized cell, it should also be specified that the greater the total thickness of membrane 1, the higher the radiated note will be. The total thickness of the membrane is, in principle, less than or equal to 1 mm.

However, if several musical notes are radiated by the acoustic membrane in a musical watch, each cell 5, 6 of the first sheet 2 and/or third sheet 4 may be dimensioned for each particular musical note. Thus, a set of mini membranes is defined, each configured for the efficient radiation of one particular musical note with uniform amplification of the first natural frequencies between 1 kHz and 4 kHz. The number of cells in the first and/or third sheets 2, 4 is thus identical to the number of musical notes capable of being generated in the musical watch. To radiate between 10 and 15 notes efficiently with said membrane, between 10 and 15 cells must be made.

The first, second and third sheets, 2, 3, 4 of acoustic membrane 1 are made in a metallic material, which may be different for each sheet or identical, or in metallic glass for at least one of the three sheets. Preferably, the second sheet 3, which has no cells, may be made of gold or titanium, and the first and third sheets 2, 4 are made of amorphous metal or metallic glass. It is possible to envisage devising all of the sheets in gold or titanium to define a membrane made of the same material.

In order to make acoustic membrane 1, it is preferable, first of all, to machine cells 5, 6 on first sheet 2 and third sheet 4, before securing said sheets to second sheet 3 by bonding or soldering. Cells 5, 6 in the first and third sheets are machined, for example, by stamping or etching.

Acoustic radiating membrane 1 may be formed of more than two sheets having cells to define a set of sheets with cells, and at least one sheet without cells inserted between two of the sheets having cells. All of the sheets are bonded or soldered on to each other. Each sheet may have the same thickness, for example, on the order of 0.1 mm, or a different thickness from each other, but the total thickness of the membrane must, in principle, be less than or equal to 1 mm according to the material selected. Each sheet with cells may thus be configured to radiate a determined note from among several notes to be radiated by the membrane with uniform amplification.

FIG. 2 shows a simplified, three-dimensional view of acoustic membrane 1, once all of the sheets have been assembled. This acoustic membrane 1, for assembly in a striking or musical watch, may be of circular shape with a diameter of between 20 and 40 mm, and preferably close to 31 mm. It may be flat or dome-shaped, as shown partly in FIG. 3 explained hereinafter.

It is also to be noted that instead of providing a first sheet 2 having cells 5 on a first thickness of the total thickness of acoustic membrane 1, projecting portions may be made on a first thickness of said membrane. These projecting portions (not shown) are integral with the cell-free base of the membrane. The portions may also be configured in a honeycomb and each tuned to radiate one particular note efficiently.

FIG. 3 thus shows a partial cross-section of a striking or musical watch 10. Watch 10 essentially includes an acoustic radiating membrane 1 according to the invention, for improving the acoustic efficiency of a note or notes produced by a striking mechanism. This acoustic membrane may include two or three sheets 2, 3, 4, wherein one or two sheets 2, 4 have cells 5, 6 and an intermediate sheet 3 has no cells. At least the two sheets with cells may be made of an amorphous metal or metallic glass, which is a corrosion resistant material, whereas the second intermediate sheet 3 may be made of gold or titanium. The thickness of membrane 1 may be less than or equal to 1 mm.

Striking or musical watch 10 also includes a watch movement 20, which is generally mounted on a plate 24. An edge part 22 is secured to plate 24, which defines a watch frame. Usually, both plate 24 and the edge part 22 are made of a metallic material.

The watch movement 20 includes a striking mechanism which is not shown. This striking mechanism may include at least one gong mounted on a gong-carrier integral with plate 24, and at least one hammer rotatably mounted on the plate for striking said gong at determined times. The generally circular gong surrounds the various parts of the watch movement of the striking watch. This striking mechanism is provided for indicating a programmed alarm time or minute repeaters.

In a more elaborate musical watch embodiment, the striking mechanism may include a pin-barrel with a set of tongues connected to a heel, which is secured to plate 24. A musical note or succession of notes is produced by the vibrating tongues of the pin-barrel. Each tongue is normally configured to produce one particular note, but there may be some groups of two tongues so that each group produces the same particular note. To produce music, for example at programmed times, the pin-barrel tongues are raised and then released by pins integral with a rotating disc or cylinder on plate 24. Each actuated tongue mainly oscillates at its first natural frequency. The vibrations generated by the actuated tongues are transmitted to the exterior parts of the watch, which must allow the sound produced by each vibrating tongue to radiate acoustically.

In this embodiment, the acoustic membrane 1 is in the shape of a dome, the top edge of which is mounted, in a sealed manner via an annular gasket 18, on an inner annular edge of back cover 15 of the case. The diameter of this dome, which may be the same as the diameter of watch glass 12, may be between 20 and 40 mm and is preferably close to 31 mm. An annular support 21 supports plate 24 on one side with edge part 22 and rests on the top edge of acoustic membrane 1. When middle part 14 is secured to back cover 15 of the watch case, support 21 and the peripheral edge of acoustic radiating membrane 1 are clamped between middle part 14 and the edge of back cover 15.

Back cover 15 is removably mounted by known means on middle part 14 with a sealing gasket 19. A watch crystal 12 is secured notably to bezel 13 to close the watch case in a sealed manner. A dial 23 is held on the edge of the middle part and arranged underneath watch crystal 12. In the case of a striking watch 10, time indicating hands, which are not shown, are provided on the dial, which generally carries hour symbols on the periphery thereof.

The central part of the acoustic membrane is not in contact with support 21 and the inner surface of back cover 15. Consequently, a sufficient space 17 is provided in the case for the acoustic membrane to be able to vibrate freely or radiate acoustically. Acoustic membrane 1 and back cover 15 thus together form a double back cover. One or several apertures 16 are also provided laterally through back cover 15 to allow the acoustic membrane to radiate the sound produced by the striking mechanism towards the exterior.

During operation of the striking mechanism, the note or notes produced by said striking mechanism are transmitted straight to the acoustic membrane to make it vibrate. Connecting parts 21, 22 and 24 also transmit vibration to the acoustic membrane 1 at the edge thereof. Since the acoustic membrane is formed of sheets made of gold or titanium or partly of amorphous metal, it is capable of vibrating at several first natural frequencies, which depend upon the number of notes to be radiated. These first natural frequencies are preferably within the useful acoustic band between 1 and 4 kHz. The second natural vibration frequencies of the notes are, however, higher than 4 kHz. This is very advantageous given that the second vibration frequencies are often sound destructive. These desired natural acoustic vibration frequencies of the partly amorphous metal membrane are dependent upon physical properties, such as density and the Young's modulus. Moreover, with this type of membrane, very low damping is observed, which provides very good acoustic efficiency for acoustic membrane 1.

Owing to the fact that this membrane is made of corrosion resistant materials, it can be mounted on a back cover, made, for example, of precious metal, such as gold. There is no difference in electrochemical potential observed even in a humid environment, which means that no corrosion occurs on contact between membrane 1 and back cover 15.

The metallic glass or amorphous metal used to make at least two sheets with cells for the membrane can, for example, be a titanium, zirconium and beryllium based metal alloy. Thus, by way of more specific example, the amorphous metal alloy may include 41% zirconium, 14% titanium, 12% copper, 10% nickel and 23% beryllium. The Young's modulus of this alloy is 105 GPa and the limit of elasticity is 1.9 GPa. The amorphous metal alloy may also be formed of 57.5% platinum, 14.7% copper, 5.3% nickel and 22.5% phosphorus. The Young's modulus of this alloy, in this case, is 98 GPa and the limit of elasticity is 1.4 GPa.

From the description that has just been given, several variants of the acoustic radiating membrane for a music box or striking watch can be devised by those skilled in the art without departing from the scope of the invention defined by the claims. The acoustic membrane may be located in the middle part of a watch case with an aperture through the middle part for the sound radiation of the vibrating acoustic membrane. The acoustic membrane may also be located on an external part of the watch case, but arranged on at least one aperture in the case so that the note or notes produced by the striking mechanism can cause the membrane to vibrate. Several acoustic membranes may be provided, arranged at several places inside the watch case or superposed on each other. These acoustic membranes may be made with the same number of sheets with cells or a different number.

What is claimed is:

1. An acoustic radiating membrane for a music box or striking watch, wherein the membrane includes, a first sheet having a first thickness of a total thickness of the membrane, a certain number of cells being made in the first sheet, and a second sheet having no cells, wherein the first sheet is arranged on a first face of the second sheet, and wherein a shape and dimension of each cell are adapted according to a type of material and a note to be radiated by the membrane.

2. The membrane according to claim 1, wherein the membrane includes at least a third sheet provided with a certain number of cells, wherein the third sheet is arranged on a second face of the second sheet.

3. The membrane according to claim 1, wherein the cells are configured in a honeycomb arrangement.

4. The membrane according to claim 1, wherein the first, second and third sheets are made of a different or identical metallic material, or at least one of the three sheets is made of amorphous metal or metallic glass.

5. The membrane according to claim 4, wherein the second sheet is made of gold or titanium, and wherein the first and third sheets are made of amorphous metal or metallic glass or gold or titanium.

6. The membrane according to claim 1, wherein the number of cells in the first and/or the third sheets is identical to the number of musical notes to be radiated by the acoustic membrane within the audible frequency band and mainly for the first natural frequencies between 1 kHz and 4 kHz.

7. The membrane according to claim 6, wherein the number of cells, which are each configured according to the musical note to be radiated by the membrane, is set between 10 and 15, so as to amplify in a uniform manner 10 and 15 notes, generated in a music box or a striking watch.

8. The membrane according to claim 6, wherein the cells of the first sheet are arranged opposite identical cells of the third sheet.

9. The membrane according to claim 2, wherein the cells of the first sheet are configured to radiate a first musical note, and wherein the cells of the third sheet are configured to radiate a second note with uniform amplification.

10. The membrane according to claim 9, wherein the membrane includes a set of several sheets having cells, and at least a second sheet having no cells inserted between two sheets having cells, wherein all of the sheets are bonded or soldered on top of each other, and wherein each sheet having cells is configured to radiate one determined note from among several notes to be radiated by the membrane.

11. The membrane according to claim 1, wherein the thickness of each sheet is less than 0.2 mm, and preferably close to 0.1 mm, whereas the total thickness of the membrane is less than or equal to 1 mm, and wherein the membrane is circular with a diameter of between 20 and 40 mm, and preferably close to 31 mm.

12. The striking or musical watch, including a watch case, which has a middle part and a back cover having at least one lateral aperture, wherein the back cover is secured in a sealed and removable manner to the middle part, a crystal closing the case in a sealed manner, a watch movement held inside the watch case and provided with a striking mechanism capable of being actuated at determined times to produce one note or several notes, and at least one acoustic radiating membrane according to claim 1, which is arranged in the watch case.

13. The watch according to claim 12, wherein the acoustic membrane, is held on an inner edge of the back cover of the case and one part of the middle part, and wherein the periphery of the acoustic membrane is clamped with the periphery of a support of the movement between the middle part and the inner edge of the back cover of the case.

14. The watch according to claim 13, wherein the acoustic membrane has the shape of a dome, whose top edge is clamped with the annular support between the middle part and an inner annular edge of the back cover of the case, an annular sealing gasket being placed between the edge of the back cover and the annular edge of the membrane, and wherein a central part of the acoustic membrane is not in contact with the support and an inner surface of the back cover of the case, so as to define a space allowing said membrane to vibrate freely.

15. The watch according to claim 12, wherein several acoustic radiating membranes are connected to the watch case and arranged separately from each other or superposed on each other.

* * * * *